US006297778B1

(12) United States Patent
Phillips et al.

(10) Patent No.: US 6,297,778 B1
(45) Date of Patent: Oct. 2, 2001

(54) APPARATUS AND METHOD FOR ENSURING PROPER ANTENNA POSITION

(75) Inventors: John Charles Phillips, New Hill; James C. Peele, Raleigh, both of NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/449,657

(22) Filed: Nov. 30, 1999

(51) Int. Cl.[7] ..... H01Q 1/24
(52) U.S. Cl. ..... 343/702; 343/894; 455/90
(58) Field of Search ..... 343/894, 702, 343/906, 760; 455/575, 90; H01Q 1/24

(56) References Cited

U.S. PATENT DOCUMENTS 5,212,491 * 5/1993 Chin et al. ..... 343/702
5,255,001 * 10/1993 Tamura et al. ..... 343/702
5,548,827 * 8/1996 Hanawa et al. ..... 343/702
5,754,141 * 5/1998 Thompson et al. ..... 343/702
5,815,820 * 9/1998 Kiem et al. ..... 343/702
5,854,972 * 12/1998 Pennock et al. ..... 343/702
5,867,127 * 2/1999 Black et al. ..... 343/702

* cited by examiner

*Primary Examiner*—Michael C. Wimer
(74) *Attorney, Agent, or Firm*—Coats & Bennett

(57) ABSTRACT

An apparatus and method for ensuring proper antenna position of a cordless communication device having a retractable antenna, including a detector such as a light sensor or induction coil for detecting the antenna position, and an indicator for providing audio and/or visual indication of the antenna position.

8 Claims, 5 Drawing Sheets

APPARATUS AND METHOD FOR ENSURING PROPER ANTENNA POSITION

BACKGROUND OF THE INVENTION

1. Technical Field

The present invention is directed toward a communication device, and more particularly toward a cordless communication device having an antenna.

2. Background Art

A cordless communication device having a retractable antenna, for example a cellular telephone, receives and transmits signals using the retractable antenna. The communication device operates whether the retractable antenna is in an extended position or a retracted position but, when the antenna is in the extended position, maximum performance is achieved. For example, in a cellular telephone, an antenna rod and an antenna coil mounted on the cellular telephone at a base of the antenna rod radiate the signal from the communication device, providing the ability for maximum performance. However, while the antenna is in the retracted position, minimum performance may be realized. For example, for the cellular telephone, only the antenna coil radiates the signal from the cellular telephone, potentially minimizing performance. Such degraded performance is often disappointing to a user of the cordless communication device.

The present invention is directed to overcoming the problem discussed above.

SUMMARY OF THE INVENTION

In one aspect of the present invention, a cordless communication device including a retractable antenna includes a detector mounted to the cordless communication device for detecting the antenna position and a controller coupled to the detector for determining the antenna position responsive to the detector. An indicator is coupled to the controller for indicating the antenna position.

In one form of this aspect, the detector includes a light emitting diode (LED) for emitting light and a photosensor positioned to sense the LED emitted light when the antenna is in the extended position, and to not sense the LED emitted light when the antenna is in the retracted position. In a further form, the LED is mounted adjacent the photosensor on an inner surface of the electronic device. In a further form, the inner surface is a first inner surface, and a reflector is mounted on a second inner surface for reflecting the emitted light to the photosensor, wherein the reflector, LED and photosensor are relatively positioned such that the emitted light reaches the photosensor when the antenna is in the extended position, and the emitted light does not reach the photosensor when the antenna is in the retracted position.

In another form, the detector includes a coil positioned to change an inductance of the coil when the antenna is placed in the extended position.

In yet another form, the cordless communication device is a cellular telephone.

In another form, the detector detects the antenna position only at a beginning of a call.

In another form of the present invention, the indicator is a speaker, and the controller is adapted to block operation of the speaker when the antenna is in the retracted position.

In another form, the indicator is a speaker, and the controller is adapted to provide an audible signal using the speaker when the antenna is in the retracted position.

In yet another form, the indicator is a display for displaying the antenna position.

In another aspect ofthe present invention, a method for indicating an antenna position of a cordless communication device having a retractable antenna is provided, including detecting the antenna position, and responsive to the detecting, providing an indication of the antenna position when the antenna is in a retracted position.

In a form of this aspect ofthe present invention, the detecting includes emitting light from an LED, and sensing for the emitted light at a photosensor, where the emitted light reaches the photosensor when the antenna is in the extended position, and the emitted light does not reach the photosensor when the antenna is in the retracted position. In a further form, the sensing for emitted light includes reflecting the emitted light from a reflector toward the photosensor.

In another form ofthe present invention, the detecting includes detecting inductance of a coil proximately spaced from the antenna. In a further form, a current is provided through the coil.

In another form, the cordless communication device is a cellular telephone, and the detecting is done only when a call is initiated.

In yet another form, providing an indication includes displaying the antenna position on a visual display for the communication device.

In another form ofthis aspect, providing an indication includes disabling a speaker for the communication device when the antenna position is detected as the retracted position.

In yet another form of this aspect, providing an indication includes providing an audible signal using a speaker for the communication device when the antenna position is detected as the retracted position.

It is an object of the present invention to improve performance of the cordless communication device.

DETAILED DESCRIPTION OF THE PREFERRED EMBODIMENT

Figure 1:
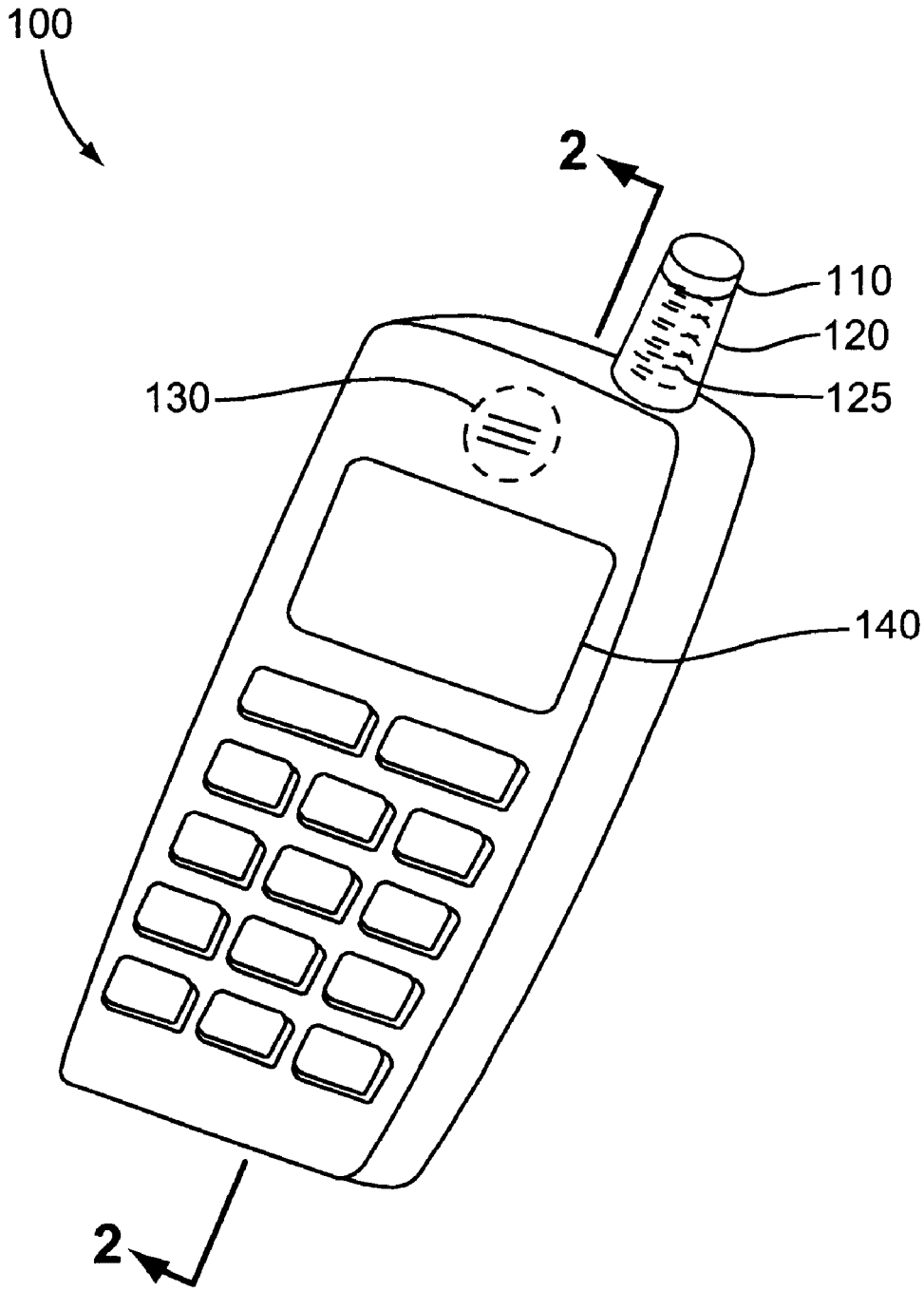
FIG. 1 is an illustration of a cordless communication device having a retractable antenna in accordance with an embodiment of the present invention.

FIG. 1 is an illustration of a cordless communication device, here a cellular telephone 100, having a retractable antenna 110 in accordance with an embodiment of the present invention. The cellular telephone 100 includes an antenna base 120 against which the retractable antenna 110 rests when in the retracted position. The antenna base 120 typically includes an antenna coil 125, which serves to transmit and receive information for the cellular telephone 100 when the antenna 110 is retracted.

The cellular telephone 100 further includes a speaker 130 which provides audible information to a user, and a display device 140, which provides visual information to the user. The speaker 130 and/or the display 140 are suited to serve as an indicator for indicating the antenna 110 position, as discussed below.

Figure 2A:
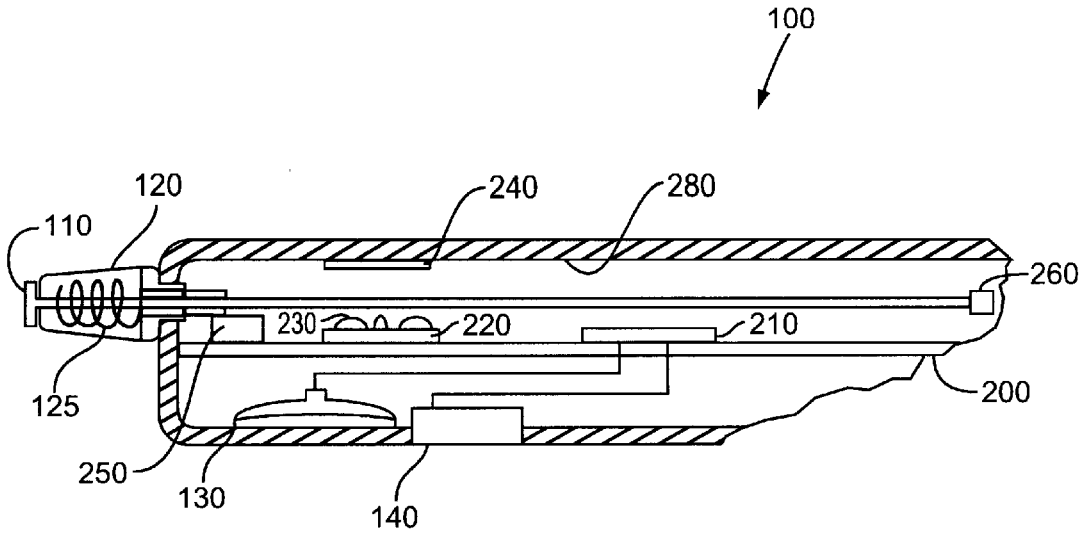
FIG. 2*a* is a simplified partial cross section of a first embodiment taken along line 2—2 of FIG. 1, where the antenna is retracted.
Figure 2B:
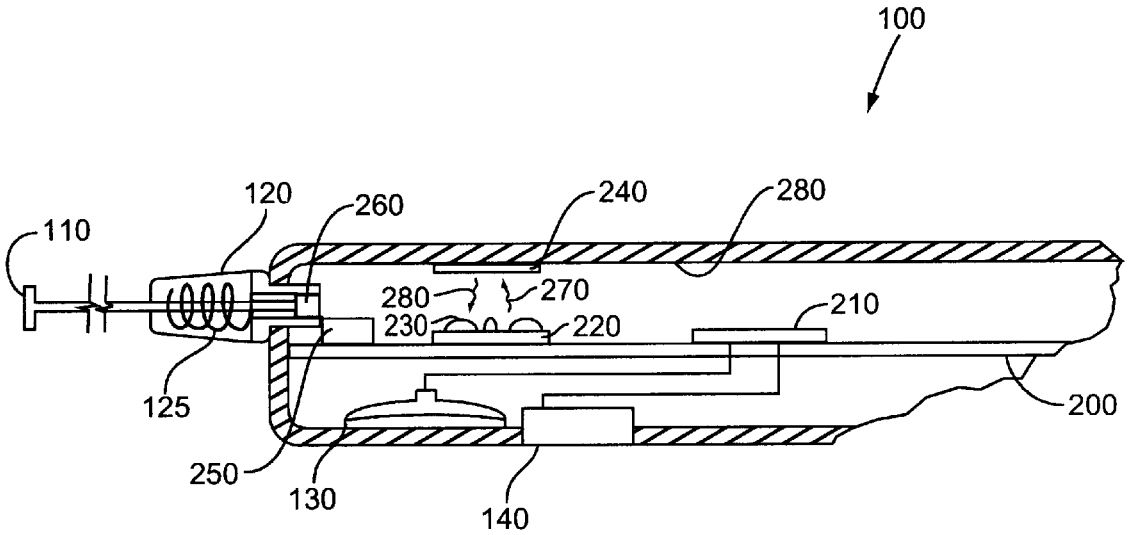
FIG. 2*b* is a simplified partial cross section similar to FIG. 2*a* but with the antenna extended.

FIGS. 2*a* and 2*b* show a simplified partial cross-section ofthe cellular telephone 100 along line 2—2 of FIG. 1. FIG. 2*a* shows a cross section where the retractable antenna 110 is retracted in accordance with an embodiment of the present invention. FIG. 2*b* shows a cross section where the antenna 110 is extended in accordance with an embodiment of the present invention.

A printed circuit board (PCB) 200 is mounted within the cellular telephone 100. A controller 210 is mounted on the PCB 200, and is coupled to the speaker 130, the display 140 and a detector, here shown as a light-emitting diode (LED) 220 and a photosensor 230. Although no physical connection is shown between the controller 210 and the LED 220 and photosensor 230, the connection exists via the PCB 200. A reflector 240 is mounted on an interior wall 280 of the cellular telephone 100 opposite the LED 220 and the photosensor 230. The LED 220 and the photosensor 230 are positioned on the PCB 200 relative to the antenna 110 such that the antenna 110, in its retracted position, blocks light emitted by the LED from being detected by the photosensor 230.

The PCB 200 further includes a PCB coupler 250 which couples the PCB 200 to the antenna coil 125 while the antenna 110 is retracted. The PCB coupler 250 couples the PCB 200 to both the antenna coil 125 and the antenna 110 via an antenna coupler 260 when the antenna is in the extended position shown in FIG. 2*b*.

In operation, light emitted by the LED 220 is blocked by the antenna 110 when the antenna is in the retracted position, as shown in FIG. 2*a*. The controller 210 is suitably programmed to determine that the antenna is in the retracted position when the controller 210 does not receive a signal from the photosensor 230 indicating that the emitted light from the LED 220 is detected at the photosensor 230. The controller 210 is further suitably programmed to provide an indication via at least one ofthe speaker 130 and the display 140. Where the speaker 130 provides the indication, the indication may be an audible signal such as a "beep" or other tone, or may be a pre-recorded message stored in a suitable memory (not shown) in the cellular telephone 100 and sent to the speaker 130 via the controller 210. The message may be, for example "antenna not extended". Where the indication is provided by the display 140, such as a liquid crystal display (LCD), the indication may be a written message, for example "antenna not extended" written on the display 140, or could be a flashing symbol likely to attract the attention of the user.

When the antenna 110 is extended, shown in FIG. 2*b*, light emitted by the LED 220, designated by the arrow 270 is reflected from the reflector 240, and reflected light designated by an arrow 280 is received at the photosensor 230. The controller 210, being coupled to the photosensor 230 receives a signal from the photosensor 230 that the light emitted by the LED 230 is detected, thereby indicating that the antenna 110 is in the extended position.

In a further embodiment, the controller 210 is suitably programmed to cause the LED 220 to emit light only when a call is initiated, for example when the user of the cellular telephone 100 is placing a call, or receiving a call. The controller 210 may direct the LED 220 to stop emitting light when the antenna 110 is extended, or when the call is completed.

In a further embodiment, the controller 210 may provide the indication via the speaker 130 by disabling operation of the speaker 130 until the antenna 110 is placed into the extended position. Once the antenna 110 is placed into the extended position, the controller 210 enables the speaker 130.

In a further embodiment, one skilled in the art would realize that, depending on the sensitivity of the photosensor 230, and the type of LED 220 used, a reflector 240 may not be necessary, as the emitted light from the LED 220 may be received at the photosensor 230 when the antenna 110 is extended without use of the reflector 240. For example, the inner wall 280 of the cellular telephone 100 may be sufficiently reflective for reflecting light emitted by the LED 220 to the photosensor 230.

In a further embodiment (not shown), where the antenna 110 is guided via a sleeve within the cellular telephone 100, the sleeve may have holes bored there-through, sufficient for the photosensor 230 to detect light emitted by the LED 220 when the antenna 110 is in the extended position.

In a further embodiment not shown, where the antenna is guided by the sleeve, the sleeve may be formed from a transparent or semi-transparent material sufficient for the light emitted by the LED 220 to be detected at the photosensor 230 when the antenna 110 is in the extended position.

Having the LED 220 and the photosensor 230 for detecting the position ofthe antenna 110 provides improved performance to the user of the cellular telephone 100, as an indication is provided to the user when the antenna 110 is not in the extended position. Further, having the controller 210 cause the LED 220 to emit light only at the beginning of a call conserves battery power. Additionally, having the speaker 130 and the display 140 provide the user with the indication of the antenna position, thereby directing the user to extend the antenna 110 to achieve maximum potential performance.

Figure 3A:
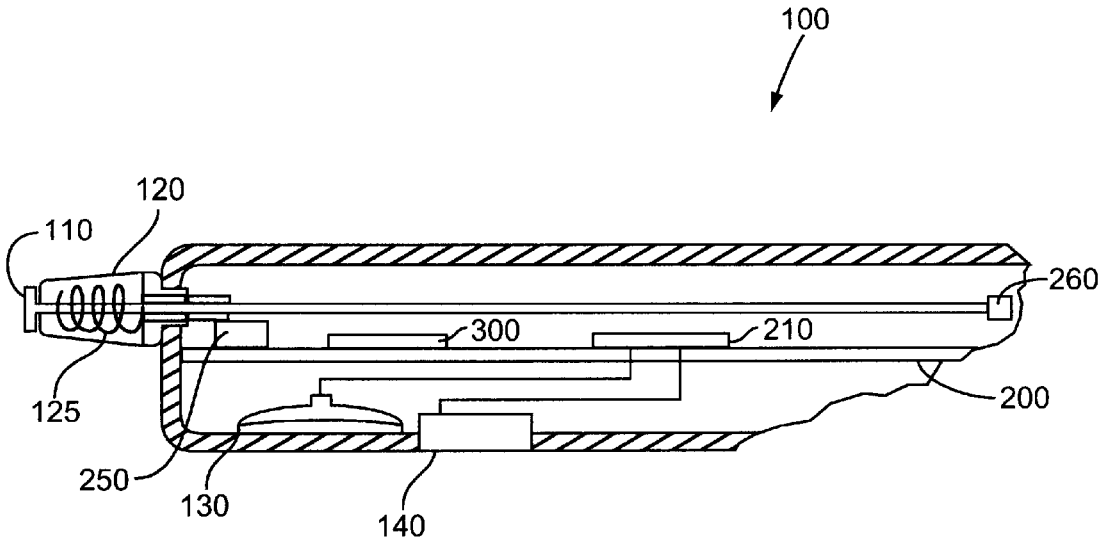
FIG. 3*a* is a simplified partial cross section similar to FIG. 2*a* but of an alternate embodiment.
Figure 3B:
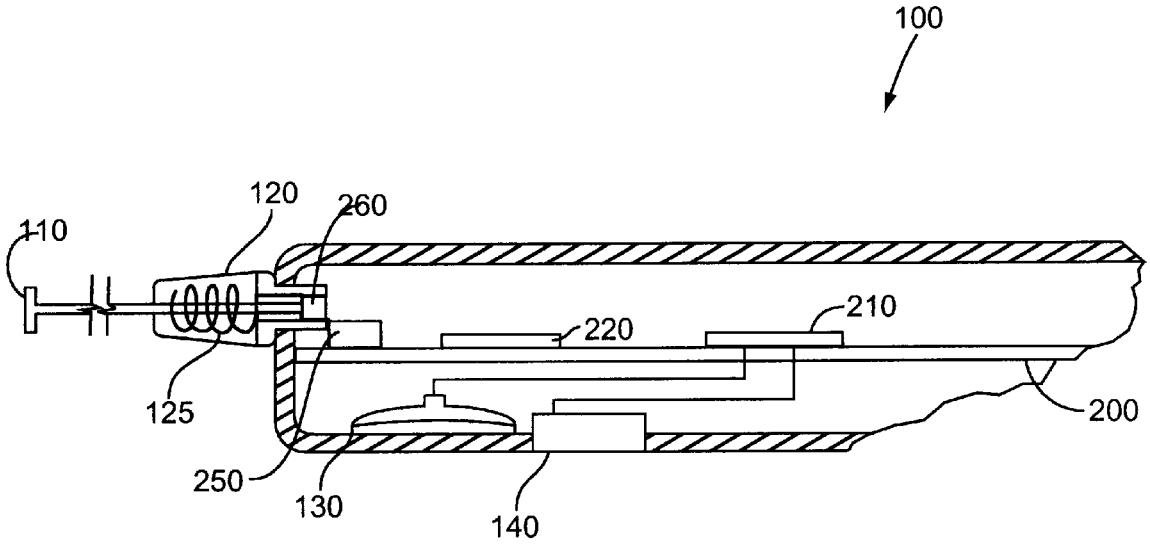
FIG. 3*b* is a simplified partial cross section of the FIG. 3*a* embodiment with the antenna extended.

In an alternate embodiment of the invention shown in FIGS. 3*a* and 3*b*, a coil, or inductor 300 is mounted on the PCB 200 and coupled to the controller 210 via the PCB 200. An inductance change across the coil 300 caused by the antenna 110 allows the controller 210 to determine the antenna position 110 as being retracted (FIG. 4*a*) or extended (FIG. 4*b*) as discussed below. Where the controller 210 determines that the antenna 110 is in the retracted position, indications as discussed above may be provided to the user ofthe cellular telephone via the speaker 130 and the display device 140.

Figure 4A:
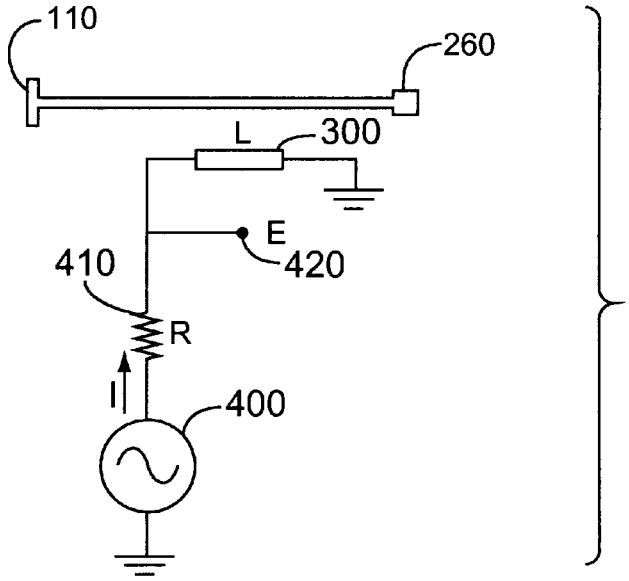
FIG. 4*a* is a schematic diagram of the FIGS. 3*a*–3*b* embodiment with the antenna retracted.
Figure 4B:
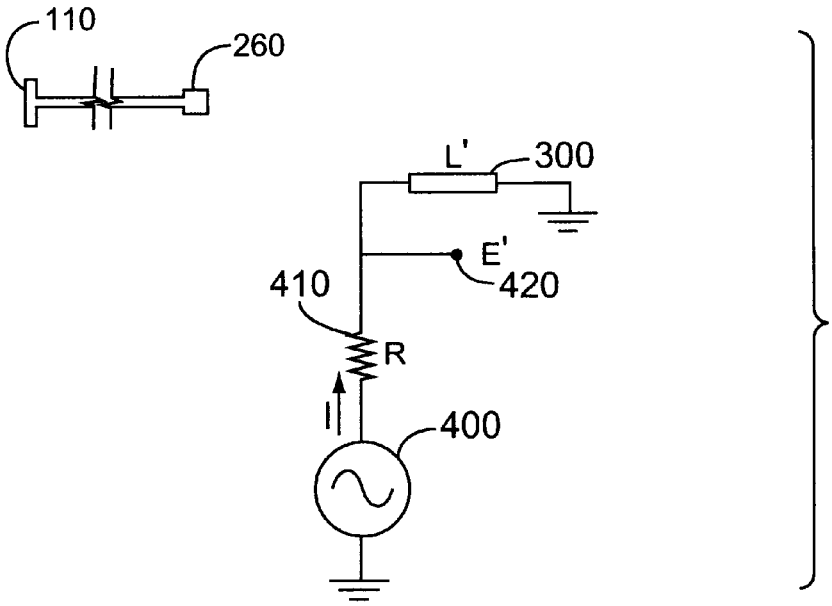
FIG. 4*b* is a schematic diagram of the FIGS. 3*a*–3*b* embodiment with the antenna extended.

FIGS. 4*a* and 4*b* show electrical schematic diagrams of the cellular telephone 100 for implementing the detector using the coil 300. An oscillating current source 400 provides an oscillating current "I" through a resistor 410. The oscillating current source 400 may be provided by the controller 210, or by a suitable oscillating current source within the cellular telephone 100. A voltage node 420 coupled to an output of the resistor 410 provides a voltage reading across the coil 300. The voltage node 420 may be coupled to the controller 210.

In operation, when the antenna 110 is in the retracted position (FIG. 4*a*), a voltage, E, at the voltage node 420 impressed across the coil 300 is:

$$E=2\pi fLI$$

where f is the frequency of the oscillating current source 400 in hertz, L is the value of the inductor and the mutual inductance caused by the antenna 110, and I is the current supplied by the oscillating current source 400. When the antenna 110 is in the extended position, FIG. 4*b*, the inductance of the coil 300 changes to L', thereby causing a voltage E' to be present at the voltage node 420 to be:

$$E=2\pi fL'I$$

where f is the frequency of the oscillating current source in hertz, L' is the value of the inductor without the mutual inductance caused by the antenna 110, and I is the current supplied by the alternating current source 400.

The controller 210 senses the voltage provided at the voltage node 420, and thereby determines the position of the antenna 110 as being extended or retracted. The controller 210 may accomplish this using a memory table indexed by voltage values. A first voltage value of approximately E in the memory table indicates the retracted antenna position, and a second voltage value of approximately E' in the memory table indicates the extended antenna position. The voltage measurement can be done using an analog to digital converter (not shown) and comparing the digital voltage value to the memory table to determine the antenna position. Alternatively, the voltage measurement may be done in the analog domain using rectification and feeding the output to a comparator (not shown) and comparing the analog voltage measurement to a reference, where the output from the comparator indicates to the controller the antenna position.

The value of the current provided by the oscillating current source 400 is determined experimentally as would be known by one skilled in the art, based on a size of the coil 300, antenna 110 construction, and distance of the coil 300 from the antenna 110. Typically, the current provided by the oscillating current source 400 will be a very small value in the order of magnitude of microamps, and therefore may be active at all times without significant drain on the battery.

Thus, having the coil 300 as the detector provides a detector which may be active at all times without significantly draining the battery. Further, where an antenna sleeve guides the antenna 110, the coil 300 provides a detector which may detect the antenna position of the antenna 110 without a specialized antenna sleeve, for example a transparent antenna sleeve or one with holes bored therethrough.

It should be understood that in its broadest scope, the detector could be in forms other than the embodiments shown in FIGS. 2*a*–4*b*, and that any structure capable of detecting the antenna position and causing the controller to generate an indication such as described herein when the antenna is retracted could be used within the broad scope of this invention.

Figure 5:
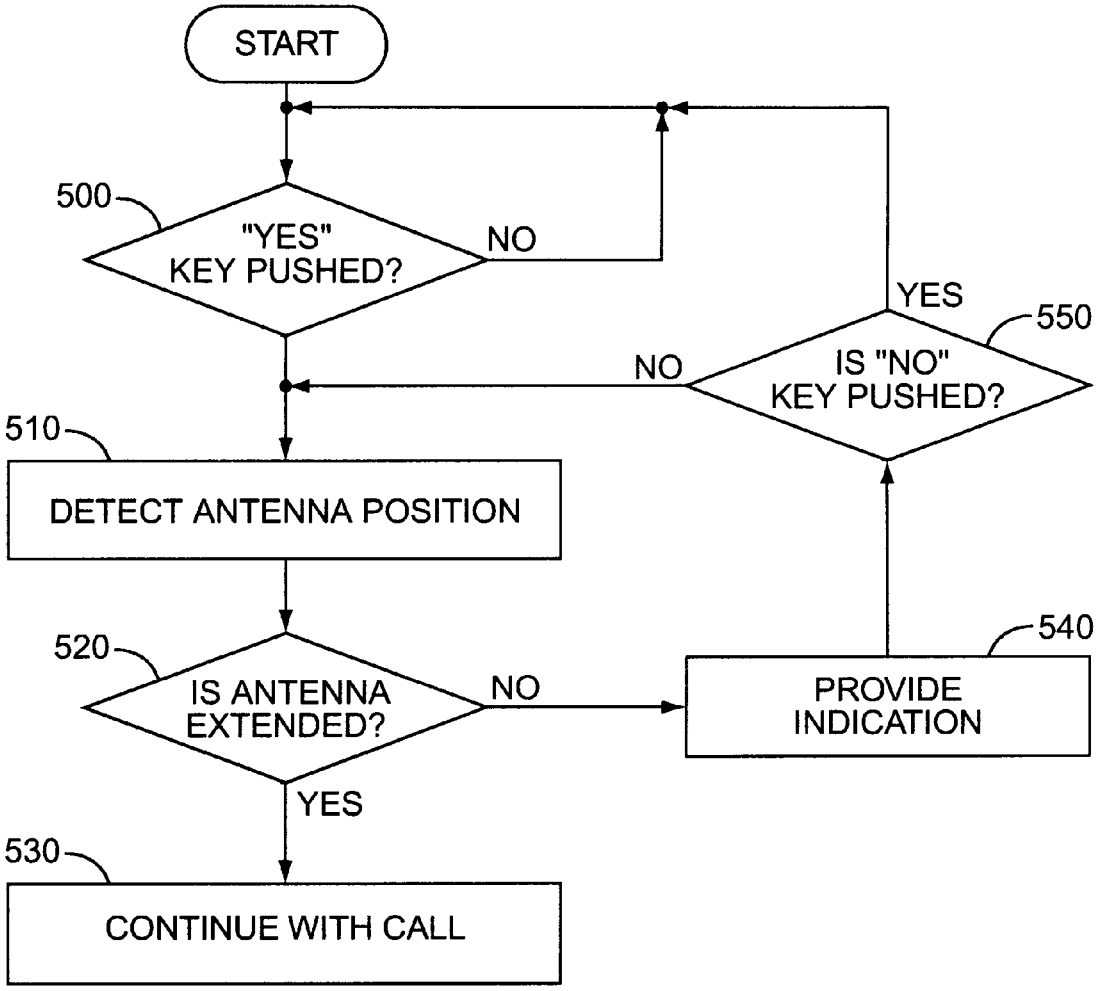
FIG. 5 is a flowchart illustrating the method of operation of the present invention.

FIG. 5 is a flowchart illustrating operation of an embodiment of the present invention. In step 500, it is detected whether the "yes" key is pushed on the cellular telephone 100, thereby indicating an initiated call. Where the "yes" key is pushed, the antenna position is detected as shown in step 510. This may be accomplished as discussed above using the LED 220 and photosensor 230, or using the coil 300 or other suitable detectors. In step 520, it is determined whether the antenna 110 is extended. This is accomplished, for example, by the controller 210 determining whether light was detected at the photosensor 230 where the LED 220 and photosensor 230 are the detector, or by determining from a voltage change at the voltage node 420 where the coil 300 is the detector. If it is determined that the antenna is extended, the call continues as normal, shown in step 530. However, if it is determined that the antenna is not extended, the method proceeds to step 540 where an indication is provided. The indication may be provided via the speaker 130 and/or the display 140 as discussed above. It is then determined in step 550 whether the "no" key is pushed, indicating that the call is ended. Where the "no" key is pushed, the method returns to step 500 and proceeds as previously discussed. If however, the "no" key is not pushed, the method returns to step 510 and proceeds as previously discussed.

Still other aspects, objects, and advantages of the present invention can be obtained from a study of the specification, the drawings, and the appended claims. It should be understood, however, that the present invention could be used in alternate forms where less than all ofthe objects and advantages of the present invention and preferred embodiments as described above would be obtained.

We claim:

1. In a cordless communication device including a retractable antenna, the improvement comprising:

a detector mounted to the cordless communication device for detecting the antenna position wherein the detector includes:

a light emitting diode (LED) for emitting light; and a photosensor, positioned to sense the LED emitted light when the antenna is in a extended position, and to not sense the LED emitted light when the antenna is in a retracted position;

a controller coupled to the detector for determining the antenna position responsive to the detector; and an indicator coupled to the controller for indicating the antenna position.

2. The improvement of claim 1 wherein the LED is mounted adjacent the photosensor on an inner surface of the electronic device.

3. The improvement of claim 2 wherein the inner surface is a first inner surface, and further including a reflector mounted on a second inner surface for reflecting the emitted light to the photosensor, the reflector, LED and photosensor relatively positioned such that emitted light reaches the photosensor when the antenna is in the extended position, and emitted light does not reach the photosensor when the antenna is in the retracted position.

4. In a cordless communication device including a retractable antenna, the improvement comprising:

a detector mounted to the cordless communication device for detecting the antenna position;

a controller coupled to the detector for determining the antenna position responsive to the detector; and an indicator coupled to the controller for indicating the antenna position, wherein the indicator is a speaker, and the controller is adapted to block operation of the speaker when the antenna is in the retracted position.

5. In a cordless communication device including a retractable antenna, the improvement comprising:

a detector mounted to the cordless communication device for detecting the antenna position;

a controller coupled to the detector for determining the antenna position responsive to the detector; and an indicator coupled to the controller for indicating the antenna position, wherein the indicator is a speaker, and the controller is adapted to provide an audible signal using the speaker when the antenna is in the retracted position.

6. A method for indicating an antenna position of a cordless communication device having a retractable antenna, comprising:

detecting the antenna position including emitting light from a light emitting diode (LED); and sensing for the emitted light at a photosensor, where the emitted light reaches the photosensor when the antenna is in a extended position, and the emitted light does not reach the photosensor when the antenna is in a retracted position; and responsive to the detecting, providing an indication of the antenna position when the antenna is in a retracted position.

7. The method of claim 6 wherein the step of sensing for emitted light includes reflecting the emitted light from a reflector toward the photosensor.

8. A method for indicating an antenna position of a cordless communication device having a retractable antenna, comprising:

detecting the antenna position: and responsive to the detecting, providing an indication of the antenna position when the antenna is in a retracted position including provid-ing an audible signal using a speaker for the communication device when the antenna position is detected as the retracted position.

* * * * *